US005774767A

United States Patent [19]

Shibata et al.

[11] Patent Number: 5,774,767

[45] Date of Patent: Jun. 30, 1998

[54] METHOD OF SUPPORTING AND DRIVING CYLINDRICAL ELECTRO-PHOTOGRAPHIC PHOTORECEPTOR AND IMAGING APPARATUS THEREOF

[75] Inventors: Junichi Shibata; Susumu Honma, both of Minami-ashigara, Japan

[73] Assignee: Fuji Xerox Co., Ltd., Tokyo, Japan

[21] Appl. No.: 773,419

[22] Filed: Dec. 27, 1996

[30] Foreign Application Priority Data

Jan. 8, 1996 [JP] Japan ..... 8-000854

[51] Int. Cl.[6] ..... G03G 15/00

[52] U.S. Cl. ..... 399/167; 399/159

[58] Field of Search ..... 399/107, 110, 399/159, 116, 167, 117

[56] References Cited

U.S. PATENT DOCUMENTS

| | | | |
|---|---|---|---|
| 4,829,335 | 5/1989 | Kanemitsu et al. | 399/167 X |
| 4,975,743 | 12/1990 | Surti | 399/167 X |
| 5,323,211 | 6/1994 | Fujii et al. | 399/167 |
| 5,461,464 | 10/1995 | Swain | 399/159 |
| 5,652,077 | 7/1997 | Obinata | 399/159 X |

FOREIGN PATENT DOCUMENTS

| | | |
|---|---|---|
| A-59-90877 | 5/1984 | Japan . |
| A-59-107357 | 6/1984 | Japan . |
| A-64-4753 | 1/1989 | Japan . |
| A-1-315781 | 12/1989 | Japan . |
| A-5-27467 | 2/1993 | Japan . |

*Primary Examiner*—Sandra L. Brase
*Attorney, Agent, or Firm*—Oliff & Berridge, PLC

[57] ABSTRACT

The present invention provides a method of supporting and driving an electro-photographic photoreceptor in which total deflection can be improved and vibration sound due to the total deflection can be prevented, and an imaging apparatus realizing the method.

A sliding bearing 3 fixed to a supporting member 2 consisting of a box member is fitted into an inner circumferential surface of an end portion of a cylindrical substrate 1 in the axial direction thereof. An annular driving member 4 is fitted into the other end portion of the cylindrical substrate 1 in the axial direction thereof. A threaded hole is provided at the central portion of the driving member 4. When a screw 5 is inserted into the threaded hole, the driving member 4 is deformed in an outer diametrical direction thereof and fixed to the inner circumferential surface of the cylindrical substrate 1. The driving member 4 is caused to be rotated by a driving source (not shown) which is connected to the driving member 4 via a gear 8. The cylindrical substrate 1 is interlocked with the rotation of the driving member 4 and is thereby rotated. Since the cylindrical substrate 1 is directly supported by the sliding bearing 3 and the driving member 4, very little deflection is caused to the substrate 1 so that the generation of vibration sound due to the deflection can be prevented.

21 Claims, 10 Drawing Sheets

METHOD OF SUPPORTING AND DRIVING CYLINDRICAL ELECTRO-PHOTOGRAPHIC PHOTORECEPTOR AND IMAGING APPARATUS THEREOF

BACKGROUND OF THE INVENTION

1. Field of the Invention

The present invention relates to a method of supporting and driving a cylindrical electro-photographic photoreceptor and an electro-photographic photosensitive apparatus thereof. More particularly, the present invention pertains to a method of supporting and driving a cylindrical electro-photographic photoreceptor and an imaging apparatus thereof in which total deflection of the cylindrical electro-photographic photoreceptor used for a reproducing apparatus (i.e., copier), a printer, a facsimile, a printing machine or the like can be improved and generation of vibration sound due to the total deflection can be prevented so that a high quality of image can be formed.

2. Description of the Related Art

Conventionally, in a cylindrical electro-photographic photosensitive member (hereinafter, it is referred to as a photoreceptor), a photosensitive layer is formed on the surface of a hollow cylindrical substrate, a flange is mounted to an end portion of the cylindrical substrate in an axial direction thereof and a rotation supporting portion is fixed to the flange. A flange having a driving force transmitting portion is mounted to the other end portion of the substrate in the axial direction thereof and a rotation supporting portion is also fixed to the flange. Since it has been required for the photoreceptor to be formed into a cylindrical configuration having a high configuration accuracy which is excellent in dimensioning and surface smoothness, a substrate in prior art has been manufactured in various methods.

Namely, a substrate for a photoreceptor has been provided such as an extruded pipe due to a hot extruding in which a billet of aluminium or aluminium alloy is made from an ingot thereof, a drawn pipe due to a drawing in which the extruded pipe is drawn at a normal temperature, an impact ironing pipe (hereinafter, it is referred to as II pipe) which is formed by ironing the pipe which is extruded from the billet through a cold impact extrusion, and a blanked and deeply drawn pipe (hereinafter, referred to as DI pipe) which is made of a metal member or the like.

Such substrates as described above are manufactured through means disclosed in Japanese patent applications as below:

1) A substrate is formed by cutting end portions and an outer circumferential surface of an extruded pipe or a drawn pipe. Alternatively, a drawn pipe is annealed and the annealed drawn pipe is drawn again so that a substrate is formed. (see Japanese Patent Application Laid-Open (JP-A) No. 64-4753)
2) A substrate is formed by curling end portions of an extruded pipe and an outer circumferential surface of the pipe and, thereafter, by effecting an ironing process thereon. Alternatively, a substrate is formed with or even without cutting II pipe. (see Japanese Patent Application Laid-Open (JP-A) No. 59-90877)
3) A substrate is formed by cutting DI pipe formed by a deep drawing process. (see Japanese Patent Application Laid-Open (JP-A) No. 59-107357)
4) A substrate is formed such that a roll straightening process or a grinding, cutting or polishing process, or an electro-polishing or an anodic oxidation is effected on an electric-resistance weld pipe or a processed electric-resistance weld pipe which are formed by a high frequency welding. (see Japanese Patent Application Laid-Open (JP-A) No. 01-315781)
5) A substrate is formed such that a roll straightening process or a grinding, cutting or polishing process, or an electro-polishing or an anodic oxidation is effected on an electric-resistance weld pipe formed by a high frequency welding. (see Japanese Patent Application Laid-Open (JP-A) No. 5-27467)

A substrate of a photoreceptor must be operated to rotate smoothly around a central ax of a flange whose outer circumferential surface is used as a driving and supporting member. Therefore, an extremely high accuracy is required for a substrate itself in its forming tolerance which is set by; coaxiality of an inner diameter of the substrate with respect to an outer diameter thereof, roundness, or cylindricality on the basis of an inner diameter of the substrate as a datum, constituting a "total deflection" based on the datum inner diameter as a whole. A very fine surface roughness is also required for the outer circumferential surface of the substrate because a photosensitive layer is formed on the substrate.

In such an electro-photographic-photosensitive drum as described above in which a photosensitive layer is formed on the substrate thus formed, a pair of flanges are connected to the end portions of the substrate of the electro-photographic photosensitive drum. The drum is rotated around each of the flanges whose central axis is used as a center point of the rotation of the drum. However, conventionally, the flange is connected to the substrate by the outer circumferential portion of the flange being fitted into the inner circumferential portion of the substrate. In this case, as a method of connecting the flange to the substrate, there is provided a connecting method in which adhesion is effected by using a primary or a secondary adhesive liquid such as epoxy resin, polyurethane resin, acrylic resin or the like, a frictional connecting method in which the connection is effected by elastic and flexible deformation due to a close-fitting of the flange into the substrate after the flange has been mechanically press-fitted into the substrate, or a mechanical connecting method in which the flange is snapped into the substrate by using a stay and a washer nut. In a low-cost and compact photosensitive drum, the use of which has been increased recently, a method of adhering the flange to the substrate has been mainly used for the purpose of reducing the manufacturing cost.

However, generally, a determination is made whether an excellent image can be obtained in a photosensitive drum with flanges also by judging the deflection performance of the drum. Deflection of the photosensitive drum with flanges in which the flanges are fitted into the substrate is analyzed into elements as shown in Table 1 as below. Each of the elements is analyzed for the substrate of the photosensitive drum and the flange, respectively. It is thereby understood that each of the elements is tangled to each other with some complexity and constitutes the deflection of the photosensitive drum with flanges.

TABLE 1

| No. | Element constituting Total Deflection | Specific Method for Increasing Accuracy |
|---|---|---|
| (1) | cylindricality of an outer circumferential portion of a substrate member | |

TABLE 1-continued

| No. | Element constituting Total Deflection | Specific Method for Increasing Accuracy |
|---|---|---|
| −1 | roundness | • roll straightening/ centerless polishing<br>• cutting if a substrate is a cutting pipe<br>• detail adjustment of a cutting jig which is inserted into an inner portion of a substrate |
| −2 | verticality | • roll straightening/ centerless polishing<br>• detail adjustment of tail pressure of a lathe if a substrate is a cutting pipe |
| (2) | coaxiality of an inner diameter of a fitting portion of a substrate with an outer diameter of the substrate (thickness deviation) | • in-roll process is affected if a substrate is a cutting pipe |
| (3) | roundness of an inner diameter of a fitting portion of a substrate | • in-roll process is effected if a substrate is a cutting pipe<br>• roll straightening |
| (4) | roundness of a rotation center of a flange and the outer diameter thereof | • cutting |
| (5) | coaxiality of a rotation center of a flange with an outer diameter of a fitting portion of the flange | • 1 chuck cutting of the rotation center and the outer diametrical portion of the flange |
| (6) | difference between an inner diameter of a fitting portion of a substrate and an outer diameter of a fitting portion of a flange | • tolerance between an inner diameter of the substrate and an outer diameter of a flange for close-fitting the flange into the substrate |

As shown in Table 1, when an effort of increasing or improving deflection is made, as processes of processing components are increased, processes of inspection and frequency of inspection which are not listed in Table 1 are boosted. Simultaneously, the manufacturing cost becomes risen more and more. Conversely, even when an effort of reducing the manufacturing cost is made, any one of the aforementioned processing methods must be omitted. In this case, the total deflection becomes worse as compared to the case in which no processing methods have been omitted. As a result, an excellent image could not be obtained. Further, as for coaxiality, since an outer circumferential portion of each of the flanges is fitted into an inner circumferential portion of each of the end portions of the drum as described above, it is limited to increase deflection accuracy. Accordingly, it is difficult to obtain a desired deflection accuracy. Further, when the flange which has been formed by injection-molding is used without any improvement in deflection for reducing the manufacturing cost of the flange, the deflection of plastic itself was between 50~100 $\mu$m so that a limit for the deflection accuracy of the photoreceptor with flanges was revealed.

Further, as shown in a column (6) of Table 1, in the photosensitive drum provided with flanges, in order to minimize the deflection, a center of a tolerance between the outer diameter of the fitting portion of a flange and the inner diameter of the substrate is set such that the flange is close-fitted into the substrate by a light press-fitting even if an adhesive is used or not. Therefore, once a processing of a flange is effected, the flange and the substrate are deformed due to the close-fitting so that it becomes difficult to use the photosensitive drum repeatedly. Accordingly, it is not desired to use such a photosensitive drum with flanges as described above from a view point of a recycling of used products or components, which has been strongly desired in our society in recent years.

Further, there has been a problem in that even if a photosensitive layer is formed on the aforementioned substrate and is used as a photoreceptor in an imaging apparatus such as a copier, a printer, a facsimile, a printer or the like, and the photoreceptor for which the duration of life has been expired is collected from a market place, it is difficult to strip the photosensitive layer from the substrate without causing any damage to the substrate.

On the other hand, in recent years, a contact charging method of effecting a charging by contacting a charging member to a charged body to be charged has been put to a practical use. The contact charging method is effected such that the charging member to which voltage (for example, about 1~2 kV of D. C. voltage or an overlaid voltage of D. C. voltage and A. C. voltage or the like) has been applied is made in contact with a charged body to be charged at a predetermined pressure so that the charged body to be charged is charged to a predetermined potential. However, there has been a problem in that when a contact charging device used for the above contact charging method is employed for an imaging apparatus of a type in which an electrostatic latent image is formed by line-scanning on a photoreceptor serving as a charged body, a charging member of the contact charging device is made contact with the photoreceptor with flanges, a vibration electric field is formed between the charging member and the photoreceptor and vibration is thereby generated so that vibration sound tends to be generated.

Moreover, in a cleaning process of a photoreceptor, there has been a problem in that when a cleaning blade is made contact with the photoreceptor with flanges and slides therewith, vibration sound may be generated between the cleaning blade and the photoreceptor depending on a material of the blade and conditions of use. Further, there is a tendency that a thickness of a substrate becomes thinner, the vibration sound becomes larger. In case of using an aluminium metal (including aluminium alloy) of a low rigidity, this tendency is very noticeable.

Conventionally, in order to solve the above drawbacks and prevent the generation of vibration sound, there has been provided a method of filling a filling material formed by a metallic material, an adhesive material, and the composed material thereof into the photoreceptor. However, it is necessary to increase a thickness of the substrate for improving the rigidity of the substrate for a photoreceptor itself. In either cases, there has been a drawback in that the photoreceptor is weighed more and the manufacturing cost increases more.

SUMMARY OF THE INVENTION

It is an object of the present invention to solve the aforementioned conventional drawbacks.

Accordingly, it is an object of the present invention to provide a method of supporting and driving an electrophotographic photoreceptor and an imaging apparatus in which total deflection is improved and generation of vibration sound due to the total deflection is prevented.

It is another object of the present invention to provide a method of supporting and driving an electro-photographic photoreceptor and an imaging apparatus in which the electro-photographic photoreceptor is formed with an excellent dimension accuracy, total deflection is improved, and generation of vibration sound is prevented when an image is formed by using a contact charging method or a cleaning blade.

In order to accomplish the above, there is provided a method of supporting an electro-photographic photoreceptor in which a sliding bearing is fitted into an inner circumferential surface of an end portion of a cylindrical photoreceptor in an axial direction thereof in which a photosensitive layer is formed on a cylindrical substrate, a driving member is fixed to the other end portion of the cylindrical photoreceptor in the axial direction thereof, and the cylindrical photoreceptor is supported by the sliding bearing and the driving member.

Further, there is provided a method of driving an electro-photographic photoreceptor in which a sliding bearing is fitted into an inner circumferential surface of an end portion of a cylindrical photoreceptor in an axial direction thereof in which a photosensitive layer is formed on a cylindrical substrate, a driving member is fixed to the other end portion of the cylindrical photoreceptor in the axial direction thereof, and the cylindrical photoreceptor is driven by the driving member.

Moreover, there is provided an imaging apparatus in which a sliding bearing is fitted into an inner circumferential surface of an end portion of a cylindrical photoreceptor in an axial direction thereof in which a photosensitive layer is formed on a cylindrical substrate, a driving member is fixed to the other end portion of the cylindrical photoreceptor in the axial direction thereof and the cylindrical photoreceptor is freely driven by the driving member.

In accordance with a method of supporting an electro-photographic photoreceptor of the present invention, an end portion of a cylindrical photoreceptor in an axial direction thereof is supported by a sliding bearing and the other end portion of the cylindrical photoreceptor in the axial direction thereof is supported by a driving member which is fixed to the cylindrical photoreceptor. Therefore, the electro-photographic photoreceptor of the present invention is different from a photoreceptor provided with flanges in which the photoreceptor is rotated around the central axis of a pair of flanges and not a few elements such as coaxiality of an inner diameter of a cylindrical photoreceptor with an outer diameter of a flange or the like must be required for improving the deflection. Namely, in the deflection of the cylindrical photoreceptor, if the accuracy of roundness or the like of the cylindrical substrate constituting the cylindrical photoreceptor increases, the amount of deflection that the cylindrical photoreceptor generates is lessened and elements required for the deflection can be reduced. Accordingly, the collected electro-photographic photoreceptor can be reused by removing a sliding bearing and a driving member serving as a supporting member of the photoreceptor from the electro-photographic photoreceptor.

In accordance with a method of driving electro-photographic photoreceptor, since the electro-photographic photoreceptor can be driven directly by a driving member fixed to an inner circumferential surface of the electro-photographic photoreceptor without using flanges, deflection is minimized.

Moreover, in accordance with an imaging apparatus of the present invention, since the deflection of the electro-photographic photoreceptor is minimized, an excellent image forming can be effected.

The above and other objects, features and advantages of the present invention will become apparent from the following description and the appended claims, taken in conjunction with the accompanying drawings in which preferred embodiments of the present invention are shown by way of illustrative examples.

DESCRIPTION OF THE PREFERRED EMBODIMENTS

A description of the present invention will be given with reference to the drawings.

Figure 1:
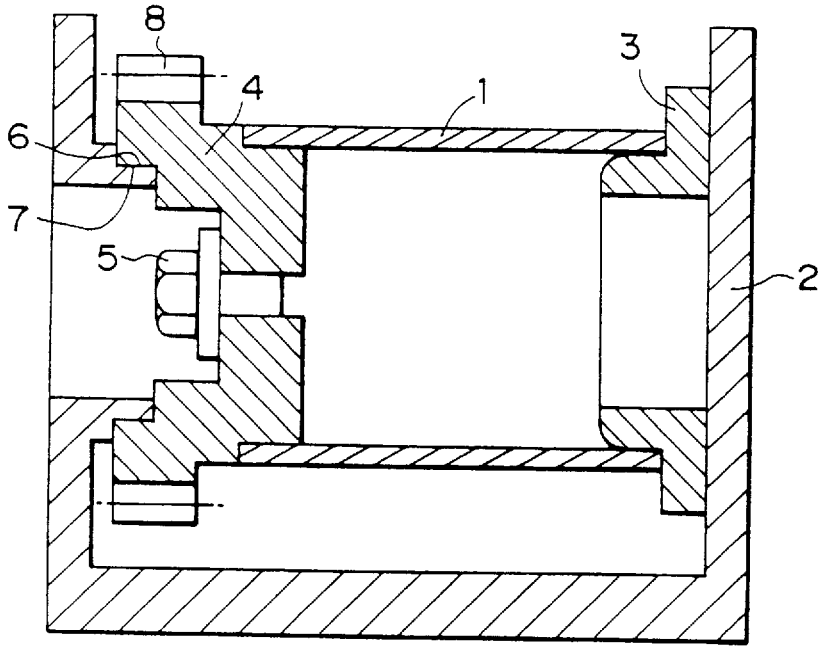
FIG. 1 is a cross sectional view of an apparatus for effecting a method of supporting an electro-photographic photoreceptor according to an embodiment of the present invention.

FIG. 1 shows an apparatus for effecting a method of supporting an electro-photographic photoreceptor according to an embodiment of the present invention.

Figure 2:
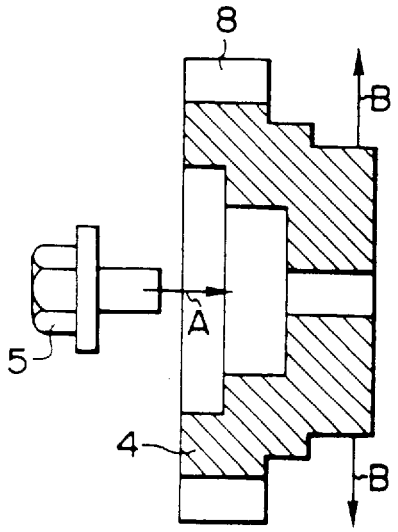
FIG. 2 is a cross sectional view of a state in which a driving member is fitted into an cylindrical substrate in FIG. 1.

As shown in FIG. 1, a photosensitive layer (not shown) is formed on the surface of an cylindrical substrate 1. A sliding bearing 3 which is fixed to a supporting member 2 consisted of a box member is fitted into an inner circumferential surface of an end portion of the cylindrical substrate 1 in an axial direction thereof. A disc-shaped driving member 4 is provided at the other end portion of the cylindrical substrate 1 in the axial direction thereof and a threaded hole is formed at the central portion of the driving member 4. As shown in FIG. 2, when a screw 5 is inserted into the threaded hole in a direction indicated by an arrow A, the driving member 4 is deformed in a direction indicated by an arrow B (i.e., an outer diametrical direction thereof) and is pressed into an inner circumferential surface of the cylindrical substrate 1 so as to effect a frictional fitting. Further, the driving member 4 has a large diametrical portion and a small diametrical portion. An annular stepped portion 6 is provided inside of the large diametrical portion. The stepped portion 6 is disposed so as to be slidable with an annular protrusion 7 which is formed at the supporting member 2. Further, a gear 8 is provided outside of the large diametrical portion of the driving member 4 in annularly and is connected to a driving source which is not shown.

In the apparatus of supporting the electro-photographic photoreceptor according to the present embodiment, the driving member 4 is driven due to a movement of a driving source and is rotated around the central axis of the screw 5. Being interlocked with the rotation of the driving member 4, the cylindrical substrate 1 which is fixed to the driving member 4 is rotated around an axis coaxially with the central axis of the screw 5 of the driving member 4 and the axis core of the sliding bearing 34. A conventional driving member of a cylindrical substrate provided with a flange member used to have caused a considerable amount of deflection. However, since the supporting means of the cylindrical substrate 1 according to the present embodiment is structured as described above, the driving member 4 causes very little deflection. Therefore, due to a cancellation of total deflection, a high quality of image can be obtained by an imaging apparatus. Further, because the total deflection has been canceled, a phenomenon in which deflection is caused due to a contact between a charging member of a contact charging apparatus and a surface of en electro-photographic photoreceptor and a phenomenon in which deflection is caused due to a contact between a cleaning blade and a surface of an electro-photographic photoreceptor or the like can be prevented.

Moreover, in an electro-photographic photoreceptor for which the duration of use has been expired, the screw 5 is loosened and removed, the driving member 4 is detached from the cylindrical substrate 1 and the cylindrical substrate 1 is detached from the sliding bearing 3. Accordingly, it is possible to separate the cylindrical substrate 1 in which a photosensitive layer has been formed on the surface of the cylindrical substrate 1 from a supporting member. Therefore, the cylindrical substrate 1 can be collected and reused by effecting a predetermined process so that the cylindrical substrate 1 can be reused.

Figure 3:
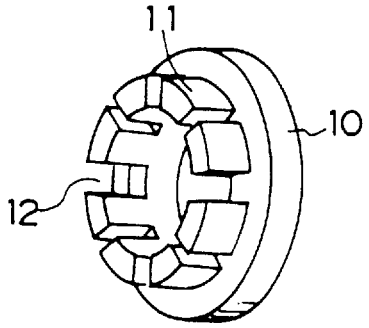
FIG. 3 is a perspective view of a sliding bearing according to another embodiment of the present invention.

FIG. 3 is a perspective view of a sliding bearing according to another embodiment of the present invention. A sliding bearing 10 has a plurality of slits 12 (i.e., eight slits in FIG. 3) which are provided to be spaced apart from each other at a predetermined distance along a cirucumferential direction of a bearing portion 11 which is fitted into an inner circumferential surface of the cylindrical substrate 1. An outer diametrical portion of the bearing portion 11 (i.e., a portion which is fitted into the cylindrical substrate 1) is made larger than an inner diametrical portion of the cylindrical substrate 1 by a few%, preferably about 3%. In a case of the above sliding bearing 10, since the sliding bearing 10 is fitted into an inner circumferential surface of the cylindrical substrate 1 such that the sliding bearing 10 is kept in close contact with the cylindrical substrate 1 due to the elastic property of the bearing portion 11, the cancellation of deflection of the cylindrical substrate 1 can be reliably effected. In accordance with the embodiment which is shown in FIG. 3, eight slits 12 are formed on the bearing portion 11. However, it should be noted that at least a slit 12 or more may satisfy the embodiment.

Figure 4:
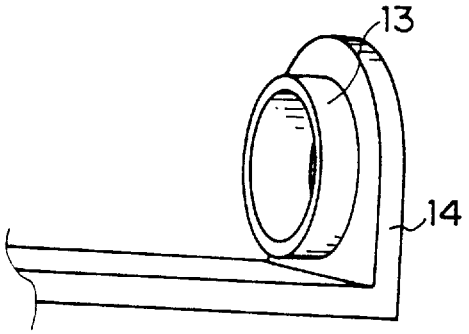
FIG. 4 is a perspective view of a sliding bearing according to another embodiment of the present invention.

FIG. 4 is a perspective view of a sliding bearing according to yet another embodiment of the prevent invention. In the present embodiment, a sliding bearing 13 is formed integrally with a supporting member 14. Since the sliding bearing 13 is integrally formed with the supporting member 14, the number of the components decreases and the manufacturing cost of the sliding bearing 13 and the supporting member 14 can be reduced.

Figure 5:
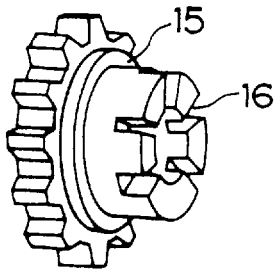
FIG. 5 is a perspective view of a driving member according to another embodiment of the present invention.

FIG. 5 is a perspective view of another embodiment of a driving member of the present invention. A plurality of slits 16 (five slits are shown in FIG. 5) are provided to be spaced apart from each other along a cirucumferential direction of a fitting portion of the driving member 15. The fitting portion is fitted into the inner cirucumferential surface of the cylindrical substrate 1. Further, the outer diameter of the fitting portion is made larger than the inner diameter of the cylindrical substrate 1 by a few %, preferably, by 3%. In the driving member 15, the fitting portion thereof is rigidly fixed to the inner circumferential surface of the cylindrical substrate 1 due to the elastic property of the fitting portion. Accordingly, the deflection due to the cylindrical substrate 1 can be canceled and the driving member 15 can be detached from the cylindrical substrate 1 so that the cylindrical substrate 1 can be reused.

According to the present invention, materials such as stainless steel and brass or the like are preferably used for the cylindrical substrate 1. Since these materials have a high mechanical strength, when a sliding bearing or a driving member is fitted into the cylindrical substrate 1, these materials are not deformed so that deflection due to their deformation is not caused. Moreover, in the present invention, it is desired that a welded pipe is used for the cylindrical substrate 1. A metal member or a metal plate is rounded and a joint portion thereof is welded. However, it is desired that the metal member or the metal plate is formed into a cylindrical configuration by TIG welding. The welded pipe which has been formed is stretched as requested, then straightened and cut as requested and further straightened as requested. Finally, it is used as the cylindrical substrate 1.

Moreover, in the cylindrical substrate 1 of the present invention, the dimension accuracy of the verticality and the roundness of the surface configuration is preferably between 0.080 and 0.002 mm and the surface roughness is between 30 and 0.2 $\mu$m in Rmax.

Next, a description of a method of forming a cylindrical substrate of the present invention using a welded pipe will be given with reference to the drawings.

Figure 6:
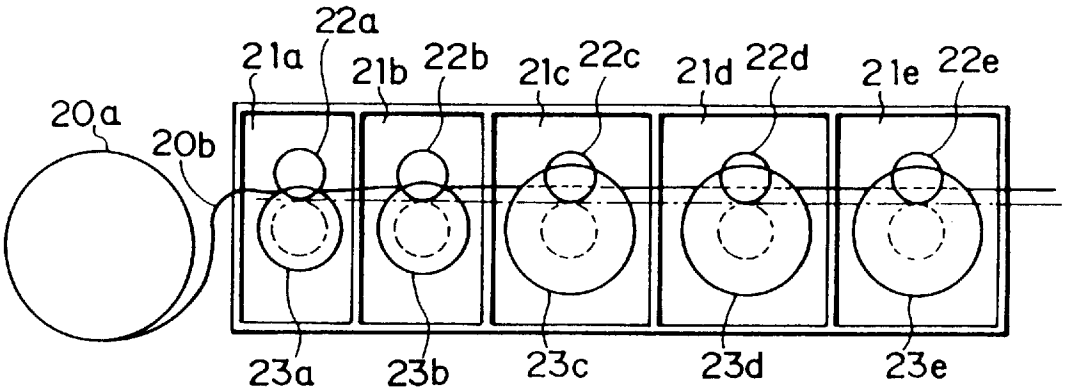
FIG. 6 is a typical view of processes of pipe forming in which a pipe is formed from a metal member.
Figure 7:
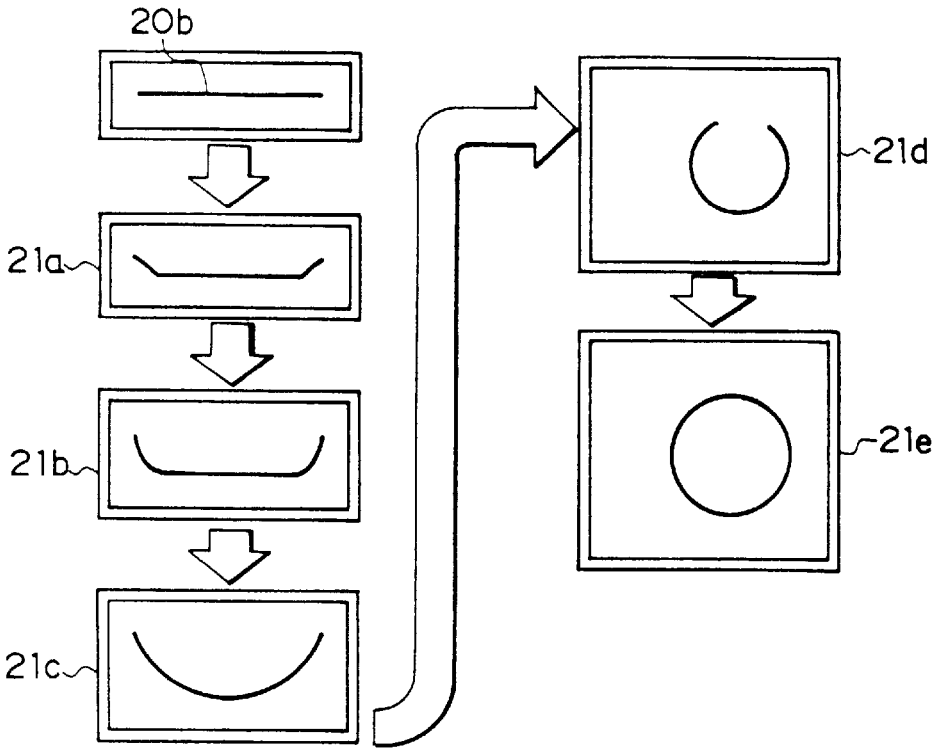
FIG. 7 is a view of a state in which the metal member is deformed in each of the processes in FIG. 6.

FIG. 6 is a typical view of a pipe forming process from a metal member . FIG. 7 is a view of a deformation state of a metal member in each of the forming processes in FIG. 4.

As shown in FIG. 6, a metal member 20*a* which is wound in a coiled state is pulled out (20*b*) from a coil , is gradually deformed into a pipe-shaped configuration through a bending process (21*a*) in which the coil is nipped between an upper bending roller 22*a* and a lower bending roller 23*a*, a bending process (21*b*) in which the coil is nipped between an upper bending roller 22*b* and a lower bending roller 23*b*, a bending process (21*c*) in which the coil is nipped between an upper bending roller 22*c* and a lower bending roller 23*c*, a bending process (21*d*) in which the coil is nipped between an upper bending roller 22*d* and a lower bending roller 23*d* and a bending process (21*e*) in which the coil is nipped between an upper bending roller 22*e* and a lower bending roller 23*e*.

Figure 8:
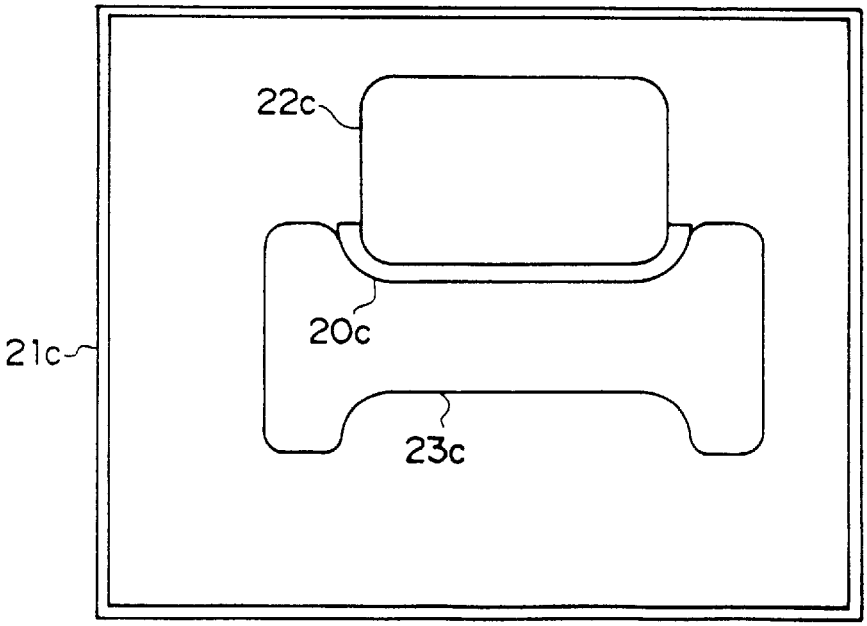
FIG. 8 is a view of a state in which the metal member is deformed in the third process in FIG. 6.

FIG. 8 is a view of a deformation state of a deformation of the metal member into a pipe-shaped configuration in a third process of FIG. 6 in which the metal member 20*c* is nipped between the upper bending roller 22*c* and the lower bending roller 23*c* and deformed.

The radius R of the end portion of the upper bending roller 22 gradually becomes larger along a direction in which each of the above processes are advanced (the bending process 1 (21*a*)→the bending process 2 (21*b*)→the bending process 3 (21*c*)→the bending process 4(21*d*)→the bending process 5 (21*e*)). The metal member 20*a* which has been subjected to the above processes is deformed in each process and finally forms a pipe-shaped configuration as shown in FIG. 7.

Figure 9:
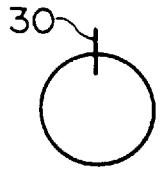
FIG. 9 is a view of a state in which a shim is meshed with a pipe material directly before the metal member is made round to be welded according to the embodiment of the present invention.
Figure 10A:
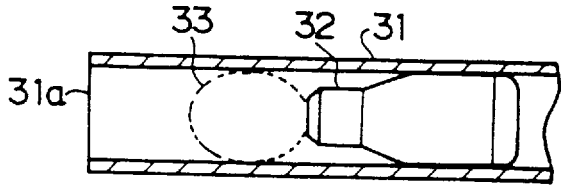
FIG. 10A is a view of illustrating a pipe drawing process.
Figure 10B:
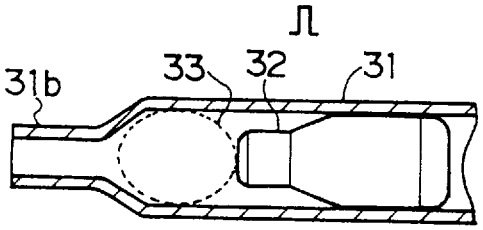
FIG. 10B is a view of illustrating a pipe drawing process.
Figure 10C:
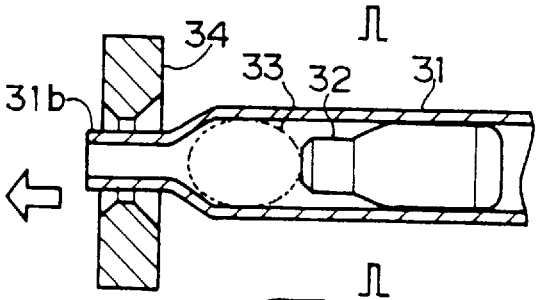
FIG. 10C is a view of illustrating a pipe drawing process.
Figure 10D:
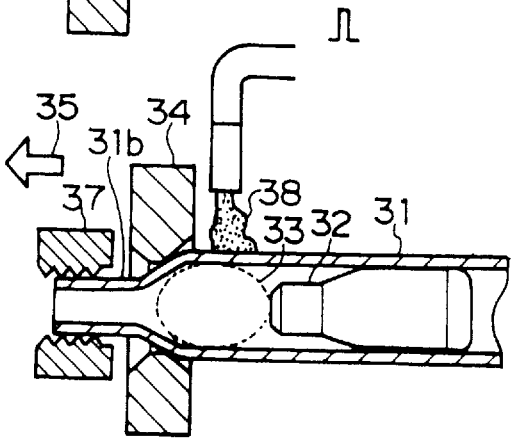
FIG. 10D is a view of illustrating a pipe drawing process.

The joint portion of the welded pipe formed in such processes as described above is welded by TIG welding. Namely, TIG welding is effected such that arc is generated between a tungsten electrode and a non-welded member and a member to be welded is fused and welded. In this case, as shown in FIG. 9, it is desired to effect a welding in inert gas such as argon gas in a state in which a predetermined gap is formed at portions of the member to be welded by interposing a shim 30 between the portions directly before the welding. The shim is interposed between the portions of the member to be welded so that generation of bead due to the welding can be prevented. The welding is effected in the argon gas to prevent the pipe material from being oxidized.

The welded pipe thus formed is subjected to a pipe stretching process as needed. The pipe stretching process is shown in FIGS. 10A through 10D.

A plug 32 is inserted into a tip end opening portion 31*a* of a pipe 31 which has been formed as described above, and filled with grease 33 (see FIG. 10A). Thereafter, the tip end opening portion 31*a* is pressed by a general press (this work is referred to as "reducing", hereinafter) (see FIG. 10B). The diameter of the reduced tip end opening portion 31*b* is between ø3mm and ø5mm. The tip end portion 31*b* is passed through a hole portion of a die 34 (see FIG. 10*c*) and is gripped by a gripper 37 and is pulled out toward an arrow indicated by 35 with a lubricating oil (i.e., the same oil as the above grease) being poured on the tip end portion 31*b* (see FIG. 10D).

Figure 11:
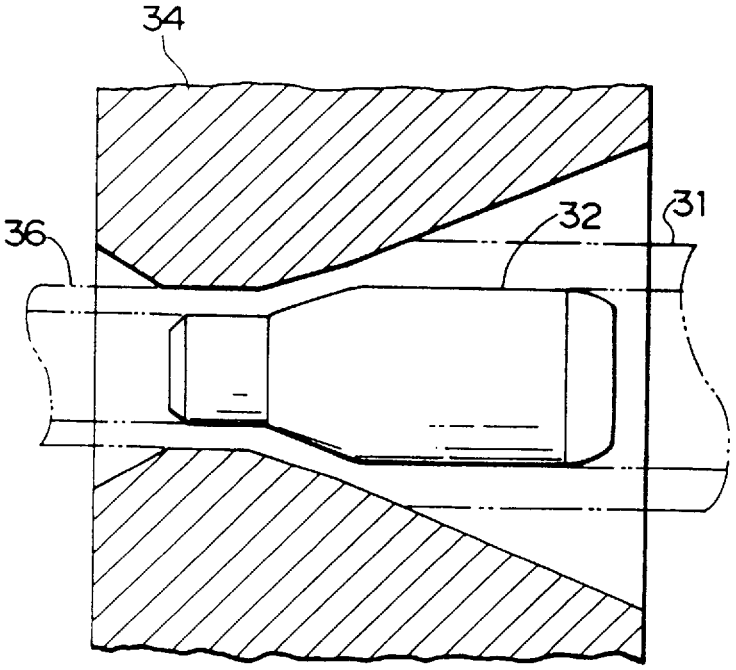
FIG. 11 is an enlarged cross sectional view of a main portion of the pipe drawing process in FIGS. 10A through 10D.

In this case, the die 34 is in contact with a portion in which a diameter of the tip end portion 31*b* which has been reduced and a diameter of the tip end portion 31*b* which has not been reduced changes gradually and resistance is generated against the die 34 when the tip end portion 31*b* of the pipe is pulled out from the gripper 37. When the pipe 31 is further pulled out against the resistance, as shown in FIG. 11, the pipe 31 is pulled out in a state that the plug 32 appears to stop within the die 34 via the pipe 31. A diameter and a thickness of a portion of the pipe 36 which has been pulled out are changed.

Moreover, super stainless steel can be used for a die and a plug. Preferably, super stainless steel which is TiN-ion plated at portions, of the die and the plug, which slide with a pipe can be used. Further, the forming rate of a pipe changes due to a quality which is required for a pipe. Generally, the forming rate of a pipe is between 2 and 30 m/min.

Figure 12A:
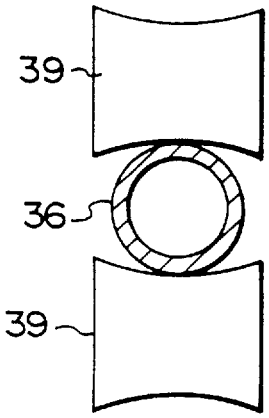
FIG. 12A is a cross sectional view of a pipe straightening process.
Figure 12B:
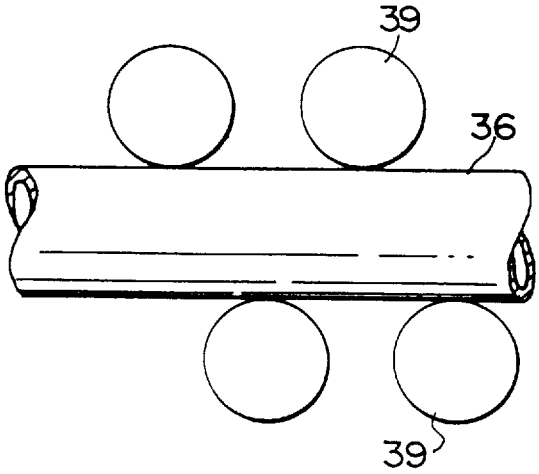
FIG. 12B is a side view of a pipe straightening process.

If desired, the pipe formed by a pipe stretching process is subjected to a straightening process as required in order to obtain a desired dimension accuracy. A straightening process of a pipe is shown in FIGS. 12A and 12B. FIG. 12A is a cross sectional view of a straightening process of a pipe and FIG. 12B is a side view thereof. In these figures, it is shown that a roller straightening process is effected such that the pipe 36 (a member to be processed) which has been subjected to the pipe stretching process is nipped by straightening rollers 39 which is provided upward and downward. When the roller straightening process is effected, a white kerosene is used as a lubricating oil. The lubricating oil is preferable because it is able to clean the grease used at the time of the above pipe stretching process.

Further, the straightening process can be applied to an elongated pipe. However, there is no problem even when the straightening process is applied to a shortened pipe as desired as a final product. Moreover, the straightening process can be applied to both lengths of pipes.

Finally, the pipe is cut into the length of a final product.

Various surface treatment processes may be effected for the pipe 31 or 36 which has been formed as described above. A surface treatment process is selected based on a surface performance required for a pipe as a substrate for a photoreceptor. The surface treatment processes include a grinding process, a mechanical polishing process, a honing process, a blast process, an electro-polishing process and annealing by high frequency currents or the like. Additionally, a wrap process, a buff process and a brush process or the like can be effected.

Figure 13A:
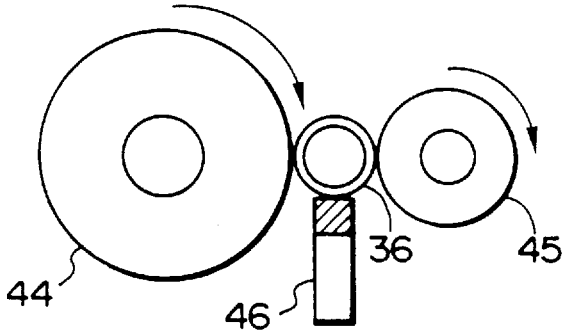
FIG. 13A is a side view of a schematic block diagram of a centerless polishing machine.
Figure 13B:
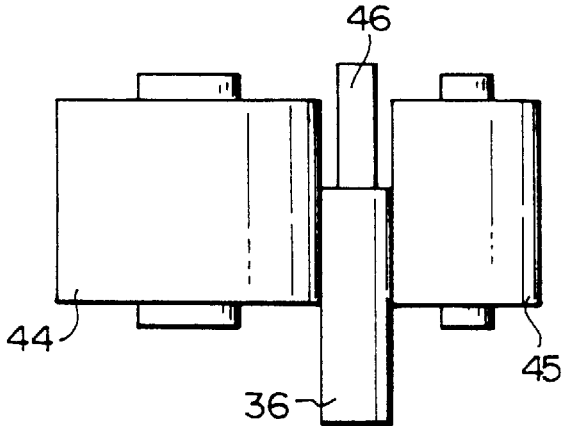
FIG. 13B is a plane view of a schematic block diagram of a centerless polishing machine.

In a case of effecting a grinding process or a mechanical polishing process as the surface treatment process, a centerless polishing machine which is shown in FIGS. 13A and 13B is used. FIG. 13A is a side view of a centerless polishing machine and FIG. 13B is a plane view thereof showing a state in which the centerless polishing machine is polishing a substrate for a photoreceptor. In this case, the pipe (a member to be processed) 36 is forwarded onto a blade 46 and passed through between a grinder 44 and an adjusting wheel 45 which are disposed so as to be spaced apart from each other at a proper distance. Thereafter, the pipe 36 is polished or ground into a desired size and a desired surface roughness. A grinding oil used for the grinding process changes depending on the surface performance required for the substrate. Typically, a water-soluble polishing oil or a kerosene is used. Further, it is preferable that the grinder 44 used for grinding or polishing is a material with a certain degree of flexibility. It is more preferable that a desired size of particle can be selected from a range of particles from the roughest to the finest thereof.

Figure 14:
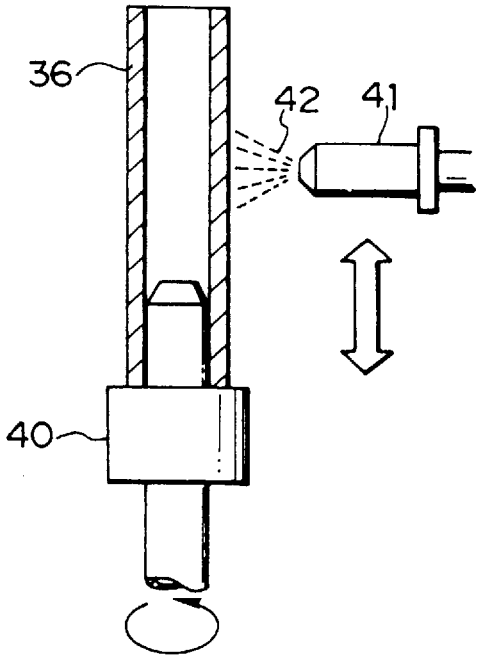
FIG. 14 is a view of a honing process.

In a case of effecting a honing process as a surface treatment process, the honing process can be effected by an apparatus shown in FIG. 14. After the pipe (a member to be processed) 36 has been chucked with a rotation chuck 40, the rotation chuck 40 is rotated at 1000 r.p.m., a suspension 42 of water and an abrasive material such as alumina particulate fine powder is guided into a honing gun 41 and is injected together with the injection of 3 kg/cm$^2$of air. At this time, the rotation of the rotation chuck 40 is synchronized with the vertical movement of the honing gun 41. As a result, a substrate of 3.0~2 $\mu$m of surface roughness (Rmas) is obtained.

Figure 15:
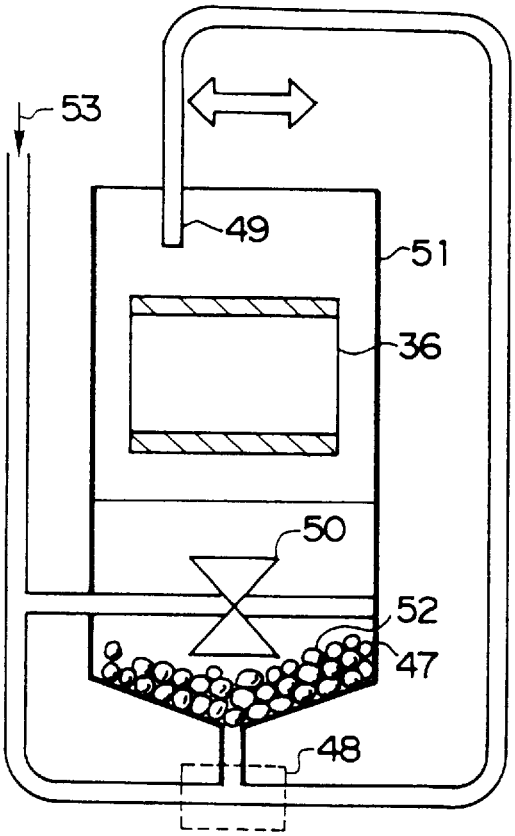
FIG. 15 is a schematic block diagram of a dry air acceleration blast processing apparatus which blows a compressed air.

A blast process as a surface treatment process is effected in a known method such as a centrifugal projection method, an air acceleration method, a belt projection method or a water injection method or the like. A schematic overall block diagram of a dry air acceleration blast processing machine is shown in FIG. 15. A projection material 52 in a pressurizing tank 47 is accelerated by a compressed air within a mixing chamber 48, is guided into a projection chamber 51, and is injected from a nozzle 49. In this case, the pressure in the pressurizing tank 47 is equilibrated with the pressure of the compressed air 53. Therefore, a mushroom valve 50 is in a closed state. If the projection material 52 is not placed in the pressurizing tank 47, the pressure in the pressurizing tank 47 is back to the atmospheric pressure so that the mushroom valve 50 is opened and the projection material 52 is placed again in the pressurizing tank 47.

Exemplary Embodiments

A description of exemplary embodiments of the present invention will be given in more detail hereinafter.

Example 1

In this example, a metal member, SUS 304, of 65 mm in width and 0.45 mm in thickness was prepared. In a manufacturing process of the metal member, a burr is caused by a stripe on manufacture. Accordingly, in this example, in order to prevent a projected portion from being formed on an outer circumferential surface of a pipe to be processed into a pipe, the metal member is set such that a side portion in which a burr is remained was positioned at an inner circumferential surface of the pipe to be processed and deformed into a pipeshaped configuration by the apparatus used in FIG. 6. Next, as shown in FIG. 9, arc was generated between a tungsten electrode and a non-welded member in a state in which a predetermined gap is formed by interposing a shim just before the welding, and a member to be welded was fused and welded. As a result, a pipe thus formed had 21 mm in outer diameter and 0.45 mm in thickness which is the same as that of the original plate member.

Next, the resulted pipe was extended by the pipe extending process shown in FIGS. 10A through 10D. Polybutene (HV-15, a product of Nippon Oil Company., Ltd.) was used as a grease. A super hard material which is TiN-ion plated at portions, of a die and a plug, which slide with a portion of the pipe was used. Therefore, a flaw-free pipe with 19.8 mm of diameter ø and 0.4 mm of thickness was obtained at the pipe forming rate of 2 m/min. Further, the pipe was straightened by using a kerosene in a straightening apparatus shown in FIGS. 12A and 12B and then cut into a desired length of a final product.

Dimension accuracy and surface roughness of the pipe formed as describe above were studied and the result is shown in Table 2.

TABLE 2

| Measured Items | Result of Measurement |
|---|---|
| verticality (μm) | 56 |
| roundness (μm) | 32 |
| surface roughness (Rmax) (μm) | 1.9 |

The above pipe was used as a substrate for a photoreceptor. A mixture of methanol and butanol was coated on 8 nylon resin (Luckamide, a product of Dai Nippon Ink & Chemicals Inc.) by dip coating. As a result, a undercoating layer with 1.0 μm of thickness was formed on the substrate.

On the other hand, a part of polyvinylbutyral resin (BM-1, a product of Sekisui Chemical Co., Ltd.) (hereinafter, 'part' refers to a part by weight) was dissolved in 19 parts of cyclohexanone and 8 parts of dibrom anthoanthron pigment (C.I. Pigment Red 168) and 0.02 parts of trifluoro acetic acid was added to the resulted solution. Next, 1 mm of diameter of glass bead was used as a dispersion medium and a dispersion process was effected by a sand mil. Cyclohexanone was added to the resulted dispersion solution and a coating solution of about 10% solid concentration was prepared. The coating solution was coated on the above undercoating layer by a ring coating machine and was dried by heating for 10 minutes at the temperature of 100° C. As a result, a charge generating layer of 0.8 μm of thickness was formed on the undercoating layer .

Next, 4 parts of N, N'-diphenil-N, N'-bis (3-methylphenyl) benzidine and 6 parts of polycarbonate resin were dissolved in 36 parts of monochlorobenzene. The resulted solution was coated on the charge generating layer by a dip coating method and was dried for 60 minutes at the temperature of 115° C. and a charge transporting layer of 18 μm of thickness was formed on the charge generating layer. As a result, an OPC (Organic photoreceptor) drum was formed.

As shown in FIG. 1, the driving member 4 is mounted to an end portion of the OPC thus formed in the axial direction thereof.

The driving member is formed by an injection molding of acetal resin and has a through hole of ø2.2 mm of an inner diameter. The outer diameter of a fitting portion which is fitted into the inner circumferential surface of the cylindrical substrate 1 was ø18.9 mm. Further, five slits are provided at the fitting portion of the driving member 4 in a circumferential direction thereof.

When an M-3 type of a self threaded screw (i.e., a tapping screw) 5 is threaded into the through hole of ø2.2 mm of an inner diameter in a state in which the fitting portion has been inserted into the inner circumferential surface of the cylindrical substrate 1, the outer diameter of the driving member 4 is enlarged so that the driving member 4 was kept in close contact with a portion of the inner circumferential surface of the cylindrical substrate 1.

Moreover, the sliding bearing 10 shown in FIG. 3 is provided at the other end portion of the cylindrical substrate 1 in such a manner that it is fitted into the inner circumferential surface of the other end portion of the OPC drum in the axial direction thereof. Thereafter, the sliding bearing 10 is mounted to a support member consisted of a box member. The sliding bearing 10 is formed by injection-molding of acetal resin. The inner diameter of the sliding bearing 10 was ø19.6 mm, which is about 3% larger than ø19 mm of the inner diameter of the OPC drum. The average thickness of the OPC drum was 2.5 mm.

The electronic-photographic photoreceptor unit thus manufactured was attached to a reproducing machine (i.e., a copier). When an evaluation of an image quality was effected, an excellent image could be obtained. Further, the distance between the electro-photographic photoreceptor unit and a developing roller was studied at eight points in a circumferential direction of the OPC drum and at eight points in the axial direction thereof. As a result, the average distance between the OPC drum and the developing roller was 0.195 mm and σ was equal to 0.012 mm.

Example 2

30 parts of super fine particle of titanium oxide of 0.09 μm of a particle diameter (STT30D, a product of Titan Kogyo K. K.) was dispersed by using a sand mil in the mixture of 100 parts of triboxyzirconium acetyl acetonate in 50% of truen solution (ZC540, a product of Matsumoto Kosho Co., Ltd.), 10 parts of aminopropyl triethoxy silane (A1199, a product of Nippon Unicar Co., Ltd.) and 130 parts of n-buthanole.

On the other hand, the above dispersion solution was coated on a surface of the substrate formed in the same manner as Example 1 by a ring coating machine and dried for 10 minutes at the temperature of 140° C. As a result, 2.0 μm of film thickness of a cured undercoating layer consisted of an inorganic cured film was formed by the reaction of zirconium compound and silane compound.

Next, hedroxygalloum phthalocyanine pigment (see Japanese Patent Application Laid-Open (JP-A) No. 5-263007) was blended with 2% of cyclohexanone solution of polyvinylbutyral resin (BM-S, a product of Sekisui Chemical Co., Ltd.) in the PB ratio of 2:1 and was dispersed for 3 hours by a sand mil. Further, the resulted dispersed solution was diluted in acetic n-butyl and coated on the undercoating layer and dried for 10 minutes at the temperature of 100° C. and a charge generating layer of 0.05 μm thickness was formed on the undercoating layer so that a charge transporting layer was formed on the charge generating layer in the same manner as Example 1. As a result, an OPC drum was formed.

In the same manner as Example 1, a sliding bearing and a driving member are fixed to end portions of the OPC drum and attached to the supporting member consisted of a box member and then attached to a laser printer using a contact charging device. When an evaluation of an image quality was effected, an excellent image could be obtained.

Further, an evaluation of vibration sound of the drum was effected at the same time. The laser printer for which the evaluation of vibration sound was effected was modified such that voltage of a printer can be switched on and/or off manually. The evaluation was effected by placing a sound and voltage indicat or 30 cm away and 40 cm upwardly from the laser printer. The evaluated frequency was twice as much as a power frequency. The result of the evaluation of vibration sound was shown in table 3.

TABLE 3

| Switching On/Off of Electric Power by Contact Charging Device | Sound Pressure | Sound Sensation Level |
|---|---|---|
| off | 48.5 dB | quiet and comfortable sound |
| on | 50.2 dB | no problem because this level is not changed so much from the above level |

Example 3

A grinding process or a mechanical polishing process was effected on the pipe described in Example 1 by a centerless polishing machine shown in FIG. 13. A kerosen was used as a grinding oil. Further, as a grinder, CBM abrasive grain was used. An in-field process was effected at a forwarding rate of 5 m/min.

Dimension accuracy and surface roughness of the pipe thus formed were shown in Table 4.

TABLE 4

| Measured Items | Result of Measurement |
|---|---|
| verticality (μm) | 9 |
| roundness (μm) | 6 |
| surface roughness (Rmax) (μm) | 0.2 |

The resulted pipe was used as a substrate for a photoreceptor. In the same manner as Example 1, a photoreceptor was formed on the substrate and a sliding bearing and a driving member were mounted thereto and attached to a supporting member consisted of a box member. Thereafter, the substrate was attached to a copier. When an evaluation of an image quality was effected, an excellent image could be obtained.

Example 4

A blast process was effected on the pipe described in Example 1. A dry air acceleration blast process was effected by using the apparatus shown in FIG. 15. A steel grid (Hc64) of 0.32 mm of average particle diameter was used as a projection material and 3 kg/cm$^2$ of pressure was applied thereto and 5 kg/min of projection amount was obtained.

Dimension accuracy and surface roughness of the pipe formed as described above were shown in Table 5.

TABLE 5

| Measured Items | Result of Measurement |
|---|---|
| verticality (μm) | 55 |
| roundness (μm) | 47 |
| surface roughness (Rmax) (μm) | 2.4 |

In the same manner as Example 2, a photosensitive layer was formed on the substrate obtained as described above. In the same manner as Example 1, a sliding bearing and a driving member are attached to the substrate and attached to a supporting member consisted of a box member and resulted in a photoreceptor unit. The resulted photoreceptor unit was attached to a laser printer and an evaluation of an image quality was effected. As a result, an excellent image could be obtained.

Example 5

A honing process was effected on the pipe described in Example 1 by using the apparatus shown in FIG. 14. The pipe was chucked with a rotation chuck and the rotation chuck was rotated at 1000 r.p.m. A suspension of water and alumina particulate fine powder as an abrasive material was guided into a honing gun and was injected together with the injection of 3 kg/cm$^2$ of air. At this time, the rotation of the rotation chuck was synchronized with a vertical movement of the honing gun.

Dimension accuracy and surface roughness of the pipe thus formed were shown in Table 6.

TABLE 6

| Measured Items | Result of Measurement |
|---|---|
| verticality (μm) | 54 |
| roundness (μm) | 42 |
| surface roughness (Rmax) (μm) | 1.8 |

The resulted pipe was used as a substrate for a photoreceptor. In the same manner as Example 2, a photosensitive layer was formed on the substrate. In the same manner as Example 1, a sliding bearing and a driving member were mounted to the photoreceptor and attached to a supporting member consisted of a box member so that a photoreceptor unit was obtained. The resulted photoreceptor unit was attached to a laser printer and an evaluation of an image quality was effected. As a result, an excellent image could be obtained.

Example 6

The pipe described in Example 1 was used. A desired surface state and a desired surface roughness were obtained in combination with an electro-polishing process. The electro-polishing process is effected by immersing the substrate in the liquid for eroding the surface of the substrate. Since the electro-polishing itself is a known art, a detailed description therefor has been omitted. A mixture of phosphoric acid and chromic acid (the ratio of 300 g of chromic acid to 1000 ml of phosphoric acid) were prepared as an electrolytic solution and was heated up to the temperature of 130° C. A member to be processed was immersed in the electrolytic solution for a few seconds.

Dimension accuracy and surface roughness of the pipe formed as described above were shown in Table 7.

TABLE 7

| Measured Items | Result of Measurement |
|---|---|
| verticality (μm) | 44 |
| roundness (μm) | 36 |
| surface roughness (Rmax) (μm) | 1.2 |

The above pipe was used as a substrate for a photoreceptor. In the same manner as Example 1, a photoreceptor was formed on the substrate. In the same manner as Example 1, a sliding bearing and a driving member were mounted to the photoreceptor and attached to a supporting member consisted of a box member so that a photoreceptor unit was manufactured. The resulted photoreceptor unit was attached to a reproducing apparatus (i.e., a copier) and an evaluation of an image quality was effected. As a result, an excellent image could be obtained.

Example 7

High frequency current annealing was applied to the pipe formed in the same manner as Example 3. As an annealing condition, the pipe is passed through a ring along which high frequency current is sent at the forming rate of 1.5 m/min. and was heated up to the temperature of 1050°~1100° C. and was gradually cooled.

Dimension accuracy and surface roughness of the pipe formed as described above were shown in Table 8.

Further, the hardness of the pipe obtained after stretching and that obtained before and after annealing were shown in Table 9 for the reference.

TABLE 8

| Measured Items | Result of Measurement |
|---|---|
| verticality (μm) | 10 |
| roundness (μm) | 5 |
| surface roughness (Rmax) (μm) | 0.2 |

TABLE 9

| Hv | Result of Measurement |
|---|---|
| before annealing | 301 |
| after annealing | 177 |

Two types of pipes including a pipe which has been annealed under the above annealing condition and a pipe before annealing were prepared as a substrate for the photoreceptor which has been formed in Example 1. Each of the pipes was chucked with a rotation chuck of a honing apparatus and the rotation chuck was rotated at 1000 r.p.m., and a suspension of water and an abrasive material(alumina particulate fine powder ) was guided into a honing gun, and was injected together with the injection of 2 kg/cm$^2$ of air. At this time, the rotation of the rotation chuck was synchronized with a vertical movement of the honing gun.

Dimension accuracy and surface roughness of the pipe formed as described above were shown in Table 10. Further, the pipe thus obtained was used as a substrate for a photoreceptor. Moreover, in the same manner as Example 2, a photosensitive layer was formed on the substrate. In the same manner as Example 1, a sliding bearing and a driving member were mounted on end portions of the substrate and attached to a supporting member consisted of a box member so that a photoreceptor unit was manufactured. The photosensitive drum was attached to a laser printer. When an evaluation of an image quality was effected, an excellent image could be obtained. The result of the evaluation of an image quality was also shown in Table 10.

TABLE 10

| Measured Items | High Frequency Current Annealing | Result of Measurement | Result of Image Evaluation |
|---|---|---|---|
| surface roughness (Rmas) (μm) | used | 1.8 | exellent image |
| | not used | 1.7 but honing irregularities were found at the welded portion | uneven density was found on the image |

Example 8

When about 4000 sheets of copies were reproduced by using a photosensitive drum described in Example 1, the photosensitive drum could no longer be used. The charge transporting layer was abraded into 16 μm in thickness and the charging ability is thereby degraded. No other damage was found in the drum. The photoreceptor for which the duration has been expired was immersed again in monochlorobenzene which has been divided into some tanks. The charge transporting layer contained in a tank was shaken vertically and dissolved. The charge transporting layer was cleaned roughly in a tank and was immersed again in monochlorobenzene in another tank so that the charge transporting layer was completely dissolved.

The charge transporting layer was taken out from a tank and dried. A confirmation was made whether irregularities were found on the layer or not. Thereafter, the charge transporting layer was formed again by coating. The OPC drum thus remanufactured could be used like a new product.

Comparative Example 1

In order to compare with Example 1, an outer circumferential portion of a flange was fitted into an inner circumferential portion of the end portion of the substrate for a photoreceptor which has been manufactured in the same manner as Example 1. In this case, since the flange is formed merely by injection-forming for reducing the manufacturing cost, no cutting process which aims to enhance the accuracy was employed. A distance between the photosensitive drum and the developing roller was studied at eight places in the circumferential direction of the photoreceptor and at three places in the axial direction thereof. As a result, the average distance (mm) between the photosensitive drum and the developing roller was 0.201 mm and $\sigma$=0.032 mm.

When an image was formed by using the above photosensitive drum, unevenness of density in the image quality was extremely noticeable.

Comparative Example 2

In order to compare the generation of vibration sound with that in Example 2 in an imaging apparatus using a contact charging device, a photosensitive drum in which a substrate made from aluminium metal (A 1050) of the same size as that of Example 2 is used was manufactured. The surface treatment was effected by the honing process described above. After the surface of the substrate has been roughened, a photosensitive layer was formed thereon as in the same manner as Example 2.

A flange was fitted into the photosensitive drum thus obtained as in Example 1 and attached to the laser printer which was modified so that the voltage can be switched ON/OFF and an evaluation of an image quality was effected. The evaluation was effected by placing a sound pressure measuring apparatus 30 cm away and 40 cm upwardly from the laser printer. The evaluated frequency indicated twice as much as the electric power frequency. The result of the measurement was shown in Table 11.

TABLE 11

| Power Switching On/Off by Contact Charging Device | Sound Pressure | Sound Sensation Level |
|---|---|---|
| Off | 48.6 dB | quiet and comfortable sound |
| On | 62.4 dB | vibration sound was uncomfortable and causes a serious problem as a product |

Effects of the Invention

Since the present invention is structured such that a cylindrical substrate constituting a photoreceptor is supported by a sliding bearing and is directly driven by a driving member, very little deflection is caused to the driving member and generation of vibration sound due to the deflection can be prevented.

Further, since a sliding bearing is fitted into the cylindrical substrate, semi-permanent connecting means such as an adhesive or the like is not used. Accordingly, the used electro-photographic photoreceptor is collected from a market place and a sliding bearing and a driving member are detached from the cylindrical substrate thereof. Therefore, a photoreceptor or the like can be processed again and reused.

Moreover, since the cylindrical substrate of the present invention is made of a stainless steel, a deformation due to the fitting of a supporting component to the substrate can be prevented and the damage caused to the substrate can be minimized. As a result, it is possible to increase a recycling rate of the product which is collected from the market place. Further, discharging sound generated when a contact charging is effected can be reduced.

While the embodiments of the present invention as herein disclosed constitute a preferred form, it is to be understood that other forms might be adopted.

What is claimed is:

1. A method of supporting an electro-photographic photoreceptor, said photoreceptor comprising:

a cylindrical photoreceptor in which a photosensitive layer is formed on a cylindrical substrate made of a rigid metal member;

a sliding bearing which is provided at an end portion of said cylindrical photoreceptor in the axial direction thereof and has a fitting portion to be fitted into an inner circumferential surface of said cylindrical photoreceptor in such a manner as to make the inner circumferential surface slidable thereabout;

a driving member which is fixed to the other end portion of said cylindrical photoreceptor in the axial direction thereof and has a fitting portion to be fitted into the inner circumferential surface of said cylindrical photoreceptor; and a box member which supports said sliding bearing and said driving member at the end portions of said cylindrical photoreceptor, wherein the method comprises inserting and fitting the fitting portions of said driving member and of said sliding bearing, respectively, to support said cylindrical photo-receptor.

2. A method of supporting an electro-photographic photoreceptor according to claim 1, wherein said driving member is mechanically and detachably fixed to said cylindrical photoreceptor.

3. A method of supporting an electro-photographic photoreceptor according to claim 2, wherein said driving member has at least two different portions of a large diametrical portion having a stepped portion and a small diametrical portion having a threaded hole at the central portion thereof, and said fitting portion of said driving member into said cylindrical photoreceptor is pressed into the inner circumferential surface of said cylindrical photoreceptor by inserting a screw into the threaded hole so that a frictional fitting is effected.

4. A method of supporting an electro-photographic photoreceptor according to claim 3, wherein an annular gear is provided outside of the large diametrical portion of said driving member which is further connected to a driving force.

5. A method of supporting an electro-photographic photoreceptor according to claim 1, wherein said stepped portion provided inside of said large diametrical portion of said driving member slides freely with respect to an annular protrusion formed at said box member.

6. A method of supporting an electro-photographic photoreceptor according to claim 4, wherein the fitting portion of said driving member into said cylindrical photoreceptor is provided with at least one slit in the circumferential direction thereof.

7. A method of supporting an electro-photographic photoreceptor according to claim 1, wherein said sliding bearing is provided with at least one slit in the circumferential direction thereof.

8. A method of supporting an electro-photographic photoreceptor according to claim 1, wherein said sliding bearing is integrally formed with said box member of said cylindrical photoreceptor.

9. A method of supporting an electro-photographic photoreceptor according to claim 1, wherein said cylindrical substrate is made of stainless steel.

10. An imaging apparatus, comprising:

a cylindrical photoreceptor in which a photosensitive layer is formed on a cylindrical substrate made of a rigid metal member;

a sliding bearing which is provided at an end portion of said cylindrical photoreceptor in the axial direction thereof and has a fitting portion to be fitted into an inner circumferential surface of said cylindrical photoreceptor in such a manner as to make the inner circumferential surface slidable thereabout;

a driving member which is fixed to the other end portion of said cylindrical photoreceptor in the axial direction thereof and has a fitting portion to be fitted into the inner circumferential surface of said cylindrical photoreceptor; and a box member which supports said sliding bearing and said driving member at the end portions of said cylindrical photoreceptor, wherein said cylindrical photoreceptor is driven freely by said driving member.

11. An imaging apparatus according to claim 10, wherein said driving member is mechanically and detachably fixed to said cylindrical photoreceptor.

12. An imaging apparatus according to claim 11, wherein said driving member has at least two different portions of a large diametrical portion having a stepped portion and a small diametrical portion having a threaded hole at the central portion thereof, and said fitting portion of said driving member into said cylindrical photoreceptor is pressed into the inner circumferential surface of said cylindrical photoreceptor by inserting a screw into the threaded hole so that a frictional fitting is effected.

13. An imaging apparatus according to claim 12, wherein said stepped portion provided inside of said large diametrical portion of said driving member slides freely with respect to an annular protrusion formed at said box member.

14. An imaging apparatus according to claim 12, wherein an annular gear is provided outside of said large diametrical portion of said driving member which is further connected to a driving force.

15. An imaging apparatus according to claim 12, wherein the fitting portion of said driving member into said cylindrical photoreceptor is provided with at least one slit in the circumferential direction thereof.

16. An imaging apparatus according to claim 10, wherein said sliding bearing is provided with at least one slit in the circumferential direction thereof.

17. An imaging apparatus according to claim 10, wherein said sliding bearing is integrally formed with said box member of said cylindrical photoreceptor.

18. An imaging apparatus according to claim 10, wherein said cylindrical substrate is made of stainless steel.

19. A method of driving an electro-photographic photoreceptor, comprising:

a cylindrical photoreceptor in which a photosensitive layer is formed on a cylindrical substrate made by bending a rigid metal member;

a sliding bearing which is fitted into an inner circumferential surface of an end portion of said cylindrical photoreceptor in an axial direction thereof;

a driving member which is fixed to the other end portion of said cylindrical photoreceptor in an axial direction thereof; and a box member which supports said sliding bearing and said driving member at the end portions of said cylindrical photoreceptor in the axial direction thereof, wherein said driving member is mechanically and detachably fixed to said cylindrical photoreceptor and has at least two different portions of a large diametrical portion having a stepped portion and a small diametrical portion having a threaded hole at the central portion thereof, wherein the method comprises pressing said fitting portion of said driving member into the inner circumferential surface of said cylindrical photoreceptor and inserting a screw into the threaded hole so that a frictional fitting is effected.

20. A driving method of an electro-photographic according to claim 19, wherein an annular gear is provided outside of said large diametrical portion of said driving member which is further connected to a driving source.

21. The method of claim 19, wherein said sliding bearing is fitted in such a manner as to make the inner circumferential surface slidable thereabout.

* * * * *